US010094102B2

(12) United States Patent
Blocker

(10) Patent No.: US 10,094,102 B2
(45) Date of Patent: Oct. 9, 2018

(54) MODULAR INTERCONNECTABLE WALL CELL

(76) Inventor: Duran Lee Blocker, San Diego, CA (US)

( * ) Notice: Subject to any disclaimer, the term of this patent is extended or adjusted under 35 U.S.C. 154(b) by 0 days.

(21) Appl. No.: 13/506,248

(22) Filed: Apr. 6, 2012

(65) Prior Publication Data

US 2013/0152502 A1 Jun. 20, 2013

Related U.S. Application Data

(60) Provisional application No. 61/472,880, filed on Apr. 7, 2011.

(51) Int. Cl.

| | |
|---|---|
| ***E04B 1/19*** | (2006.01) |
| ***E04B 1/343*** | (2006.01) |
| ***E04H 1/12*** | (2006.01) |
| *E04B 1/61* | (2006.01) |

(52) U.S. Cl.

CPC ..... *E04B 1/1903* (2013.01); *E04B 1/34315* (2013.01); *E04H 1/1205* (2013.01); *E04B 2001/6191* (2013.01)

(58) Field of Classification Search

CPC ..... E04B 1/6104; E04B 1/02; E04B 1/1903; E04B 1/34315; E04B 2001/6191; E04H 1/1205

USPC ..... 52/270, 207

See application file for complete search history.

(56) References Cited

U.S. PATENT DOCUMENTS

| | | | | |
|---|---|---|---|---|
| 2,263,511 | A * | 11/1941 | Lindsay | B61D 17/043 105/409 |
| 3,058,550 | A * | 10/1962 | Richter | 52/222 |
| 2,950,786 | A | 1/1965 | Markle | |
| 3,254,462 | A * | 6/1966 | Toler | 52/222 |
| 3,302,825 | A * | 2/1967 | Schleeweiss | E04H 4/0031 220/565 |
| 3,415,025 | A * | 12/1968 | Walz, Jr. et al. | 52/222 |
| 3,641,230 | A | 2/1972 | Meckstroth | |
| 3,641,730 | A | 2/1972 | Meckstroth | |
| 4,274,242 | A | 6/1981 | Linton | |
| 4,813,193 | A | 3/1989 | Altizer | |
| 4,961,297 | A * | 10/1990 | Bernard | E04B 1/34315 52/655.1 |
| 5,245,809 | A | 9/1993 | Harrington | |
| 5,493,836 | A | 2/1996 | Lopez-Munoz | |
| 5,870,866 | A * | 2/1999 | Herndon | 52/169.12 |
| 5,970,672 | A | 10/1999 | Robinson | |
| 6,389,778 | B1 | 5/2002 | Strange | |
| 6,802,158 | B1 * | 10/2004 | Greene | E04H 1/1205 52/270 |
| 2003/0188494 | A1 * | 10/2003 | Santa Cruz | E04H 1/1205 52/79.1 |
| 2006/0070329 | A1 * | 4/2006 | Schiltz | B44C 5/0461 52/506.01 |

(Continued)

FOREIGN PATENT DOCUMENTS

DE 3921802 A1 1/1991

*Primary Examiner* — James M Ference

(57) ABSTRACT

A modular, interconnectable wall cell that can be connected to additional modular, interconnectable wall cells to form walls, floors, roofs or other structures. The modular, interconnectable wall cell has a frame, a panel filler, stiffener plates and angle members. When the modular, interconnectable wall cell is connected to additional modular interconnectable wall cells, the cambered edges of the frame bow inwardly toward the panel filler.

1 Claim, 10 Drawing Sheets

(56) References Cited

U.S. PATENT DOCUMENTS

| | | | | |
|---|---|---|---|---|
| 2006/0123405 | A1 | 6/2006 | Godwin | |
| 2006/0123725 | A1 | 6/2006 | Godwin | |
| 2007/0000197 | A1* | 1/2007 | Patrick et al. | 52/335 |
| 2007/0094963 | A1 | 5/2007 | McDonald | |
| 2007/0234651 | A1 | 10/2007 | Gage | |
| 2009/0193734 | A1 | 8/2009 | Harig | |
| 2010/0163674 | A1* | 7/2010 | Bock | 244/118.6 |

* cited by examiner

MODULAR INTERCONNECTABLE WALL CELL

Related U.S. Application Data: Provisional application No. 61/472,880 Filed on Apr. 7, 2011.

CROSS RELATED APPLICATIONS

Prior art not previously disclosed and not obvious.

BACKGROUND OF THE INVENTION

By observing and experimenting with different concepts for personal housing needs and occupation in the construction industry manufactured product, solves needs in a society where things are growing toward smaller engineered products and highly individualized purchases. The components for this housing invention are derived from learning the structural building trade and industrial manufacturing design. The Wall Cell is an effort initiated to add efficiency and value to the housing supply in product-based, individualistic society.

SUMMARY

The invention described is manufactured metal (steel or aluminum) frame of a calculated thickness and yield and acts as a frame around wood or wood substitutes that can be assembled together horizontally and vertically to form shelter housing walls or enclosures. Their frames will include corner angles that are cross-bolted for making the corners of different frames to be one solid unit in the wall embodiment. The size of the solid unit is increased by metal plates welded to the angle in a planar position to the area of the wood or filler material. The frame edges are cambered to cause stress to cambered edges wherein increasing their tensile strength as the cross-bolted corners are tightened. Adhesive or weather proofing can be applied to the abutting edges of the frame to add to the insulation of the invention. After the assembly of a shelter or housing, the exterior layer can be covered with a conventional decorative finish. (i.e. Shingles, siding, planks or tile)

DESCRIPTION OF SEVERAL VIEWS

REFERENCE SEQUENCE LISTING

Figure 1:
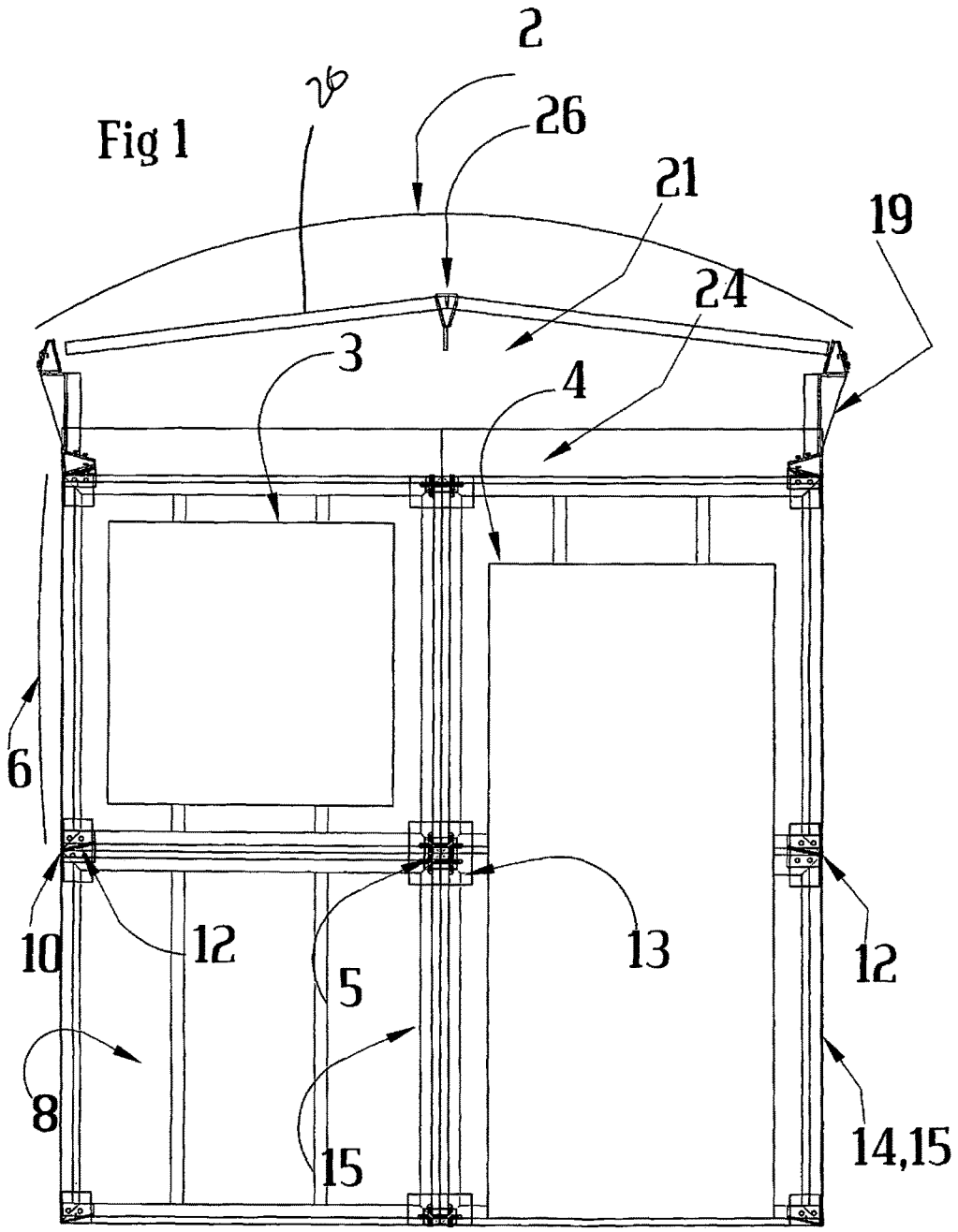
FIG. 1 is a front view of a possible assembly of wall cells in comprising a housing with labeled parts and sections. It shows wall cells that contain a single attribute and cells with alterations fitting together where in creating an attribute.
Figure 2:
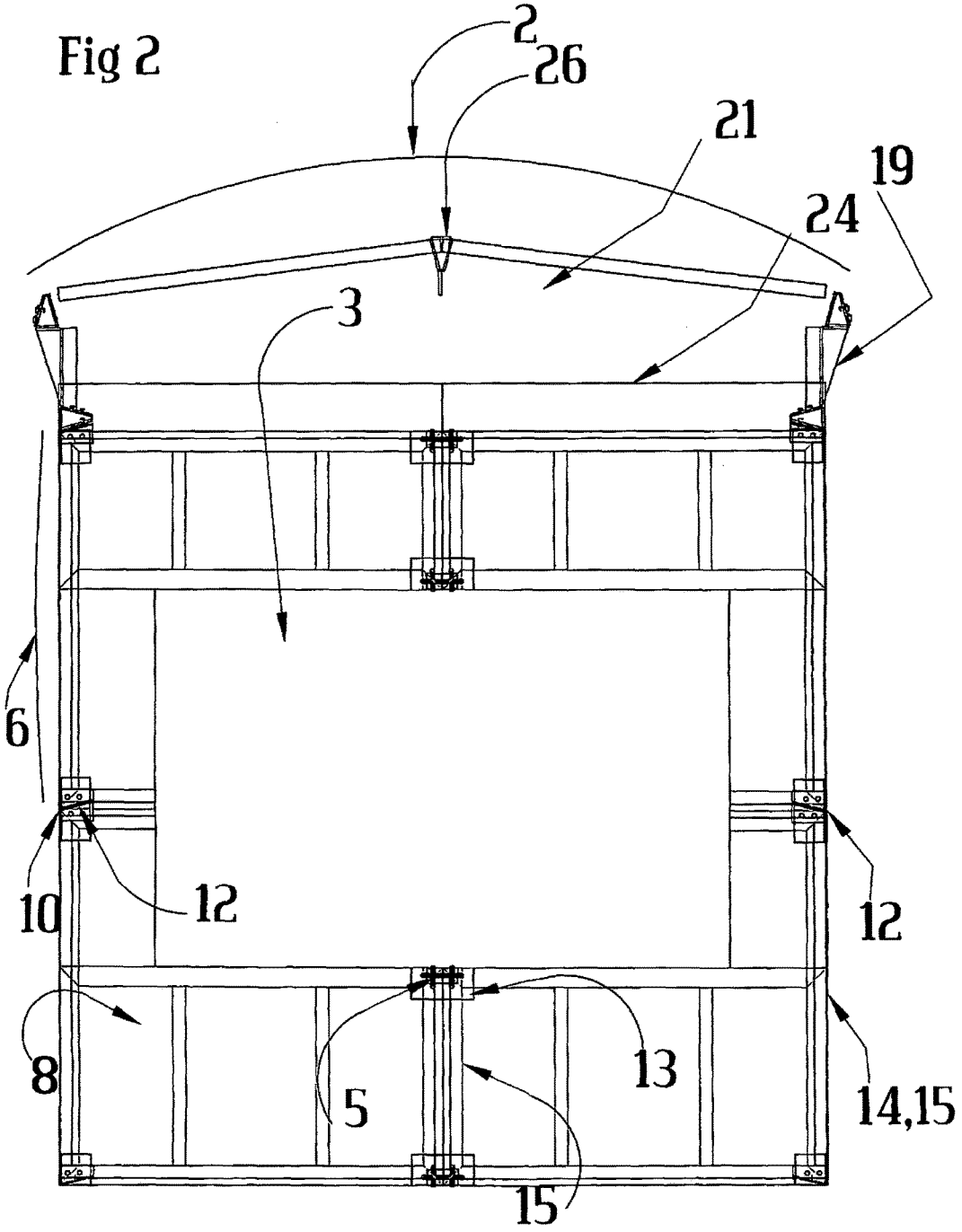
FIG. 2 is a view of a possible array of wall cells of an assembled housing with labeled parts with the Wall Cells with alterations fitting together to make an attribute.

The present invention relates to a wall cell with structural connections and cambered edges.

The device is comprised of the following components:

TABLE-US-00001 Ref Number Name of Part 2 Housing Assembly 3 Window Modifications 4 Door Modifications 5 Cross Bolts 6 Frame 7 Wall Surface 8 Filler 10 Bolted Assembly 12 Bolting Member 13 Stiffener Plate 14 Angle Edges 15 Cambered edge 16 Utility tube 17 Sealant Adhesive 18 Edge lip 19 Roof structure 20 Floor Structure 21 Roof Gasket Covers 22 Corner posts 23 Base Structures 24 Header Attachment 25 Foundation Template 26 Ridge Attachment with angle washers 27 Roof Attachments 28 Clamp Pin 29 Elevation View

DETAILED DESCRIPTION

The embodiment is comprised of numerous manufactured like parts that assembled by having a minimum amount of fastening points.

The invention is a peripheral piece that are interchanged so that the housing components can be added or removed from the embodiment with fasteners, current methods require retrofit to the housing structure.

The Housing Assembly(2) is a comprised of frames with filler known as wall cells and are designed to house anything from tools to automobiles or humans in any situation where the owners' specifications are for secondary, temporary, recreational or piecemeal construction.

The wall cells may be flat to form a box type housing or curved to form an oval shaped housing. The wall cells are capable of being manufactured using computers and mass production and then assembled in groups vertically and horizontally to form walls. They can carry segments to align into a housing door jam, or window seal. They can also carry characteristics of interior and exterior of wall, ceilings and floors. The purpose of this invention is to give flexibility to an owner to alter the housing in any given way without the need for demolishing any part of the housing. The unneeded wall cells will just be removed and replaced with wall cells carrying the characteristics desired for that section of the housing, wherein removing a solid wall cell will be and replacing the solid wall cells with wall cells containing a cut out for a door or window. (3,4)

The cross bolts (5) pull toward one intersections of three or more wall cells tightly. The bolts are common steel or stainless steel bolts that are available at almost any hardware store. There will be a special tightening instruction to assure the integrity of the connections.

The frame (6) is an assembly of structural corner elements and cambered edge elements. Its size is preferable equal lateral such as a 4 feet high and 4 feet long, but may be of any size or thickness that would increase the efficiency of the assembled wall cells. The ideal shape of the frame is square to be more geometrically sound, but other shapes can be justified for curves, truncated walls or polygraphic shapes in an assembled group of wall cells. Aspects of the (edges, bolting members and plates) are adjoined together by gluing, bolting or welding together. The invention is different from other inventions that state wall panels are stronger only after they have been attached to adjacent wall panels. Also the connections points of the invention are minimized and are uniform to comprise any planar wall ceiling or floor of a housing or shelter.

The filler (8) makes up the embodiment of the peripheral frame. The filler supports or complements the frame as needed by the application. A typical filler would be a sheet of plywood, a sheet of plastic, canvas, sheet metal or precast concrete. The purpose of the frame is to work conjunctively with the filler in maintaining the integrity of the wall while separating the housing into workable components that are assembled using the minimum amount of connection points. Each wall cell can have a separate exterior appearance and create diverse forms of decoration to the structure; however, there are many exterior siding products that are available in the common building market for covering the structures exterior surface to mask the cellular wall's connecting pattern.

The corner assembly (10) assembly is angled in a fashion to configure the wall cell. The material of the corner assembly is preferably steel, aluminum or stainless steel alloy but could be plastic or fiberglass for light duty more transportable models. Bolted members (12 are normally ⅛" to ⅜" thick metal with 2, 4 or 6 bolt holes. The metal bolted members welded at angle of 70 degrees to 110 degrees to the structural plate (13) that is parallel to the exterior side of the wall surface. The plates are typically ⅛" to ⅜" thick and 5 to 25 percent of the frame in length or width. The plates can be square, triangular or other shape that establishes the area of the solid connection and determines the rigidity and inflection strength in the assembled embodiment.

The cambered edges (15) are ideally metal, plastic or fiberglass in the form of channel, tubes, cold formed sheet metal or extruded metal. The edges are rolled to form a camber, joined by welding to the bolt assembly that bows outward from the center of the frame. It is attached at the point of the edge of the bolting member (12) so there won't be a gap in the between assembled wall cells. And double attachment is in effect when adjoining members are tightened down by using a clamp pin (28). Herdon in U.S. Pat. No. 5,870,866 discloses front-to-back congruent cambered edges; however, the connections are overlapping flanges of thin gauge material. The cambered edges are not under stress and allow for movement. The current invention has laterally opposing cambered edges that are pressed into a straight form wherein the material becomes more ridged.

The wall cells are multiple units of a housing structure with minimum connections that can be mass produced on an assembly line then transported and assembled in the field to produce a housing at any given location for the housing needs above. This is different from previous modular home inventions that are manufactured in a shop using jigs and moving large components around a spacious facility. It is yet a further improvement on the manufacturing process of wall panels in that they are ½, ⅓, ¼ or smaller of the wall height and can be mass produced in a smaller factories around the country. The wall cell can also be removed, replaced and reused from an already assembled housing by loosening the bolted members (12) of an assembled embodiment and easily pulling the bottom of the wall cell straight outward from the angled edge (14). The removal of any wall cell can be accomplished without the demolishing any of any part of the embodiment or the removed wall cell. It can then be put back into inventory and reused on another housing embodiment.

The wall cell are manufactured, inventoried, easily transported and not difficult to disassemble and replace wall cells to change attributes of an assembled housing or shelter. Each wall cell can have multiple characteristic that will affect the utility or design of the complete embodiment. Wall cells can be put back into inventory for later use. In U.S. Pat. No. 3,415,025 Walz Jr. discloses a pre-fabricated structure panels that is easily assembled and with a cambered roof and structural members in the base the assembly, but is different in from the current invention because the said panels are connected with fiberglass straps and are transported by using forklifts and trucks or trains after the housing has been assembled. The current invention is more advanced in that housing's segments are loaded on trucks at the factory and assembled at the location where it will be used.

The frame's stiffener plate (13) lays out the angle of the plain of the planar wall. The plate's purpose is to determine the shear strength of the embodiment. Toler's U.S. Pat. No. 3,254,462 describes structural wall panels that are assembled using camber material to comprise a load bearing wall. Even though the current invention could be altered and assembled to become a load bearing wall, Toler's invented walls are comprised of thin material and the cambers are for compression fitting in straight channels designed to supporting a load. It does not disclose the straightening of edges, bolting or plate of the current invention which are the design for a lateral support.

The bolting members (12) are the solid connections between wall cells. The bolting members accompany stiffener plates (13) to instill static locations in the wall and are of minimum necessary locations to allow for efficiently in assembly. They have congruent angles with the angle edge (14).

The variable material sizes and thicknesses are: 1. The size of Stiffener plates (13) in the corners are increased make a larger solid area in the embodiment that is resistance to movement. 2. The length of the Angled edges (14) determine the size of the embodiment, and a thicker angle edge will hold more bearing strength of the embodiment. 3. A size increase in the Bolting Member (12) will increase the resistance to in-reflection of the embodiment.

The Angle of the edges (14) provides an angle on the compressing edges that will allow the wall cell to pull out perpendicular from the embodiment when tension from the bolting assembly is taken off and the bolts removed. Wherein this aspect assists in the frames ability to be inserted and removed from an embodiment, a special tool for assembly will again improve this process. The cambered edges will be straightened when the bolting members are tightened thus causing stress and a slight stretch on the molecules of the edge material increasing the tensile strength and making the frame more ridged. The cambered edges compressed together minimizes the airspace between the wall cells in an embodiment. The airspace will be completely eliminated by the use of gasket seal (17) applied to the contact surface of the cambered edges.

The filler as an embodiment supplements the structural integrity of the walls. It is a part of the invention that has aspects of current type of construction, but will soon set a new ideas for other types of fillers such as recycled materials.

Figure 3:
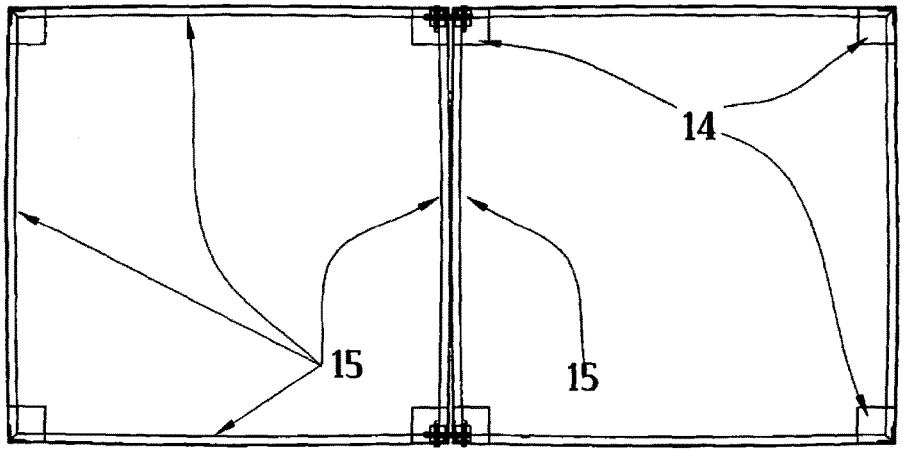
FIG. 3 is a view showing the abutment of cambered edges of two wall cells. As the structural connections are connected the camber will straighten and the abutted edges will have applied pressure.
Figure 4:
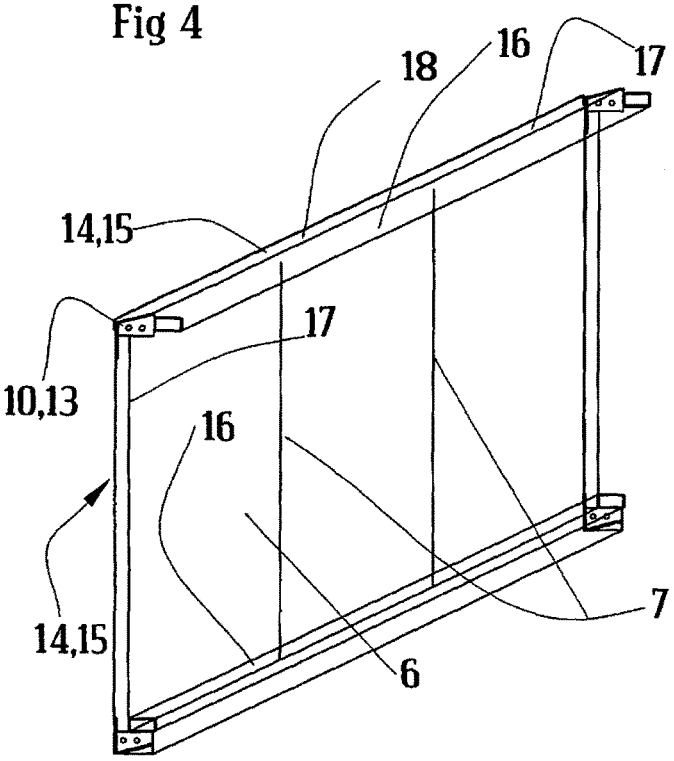
FIG. 4 is an angle view that shows intersections of the bolting connection with the planar frame in a perpendicular fashion.
Figure 6:
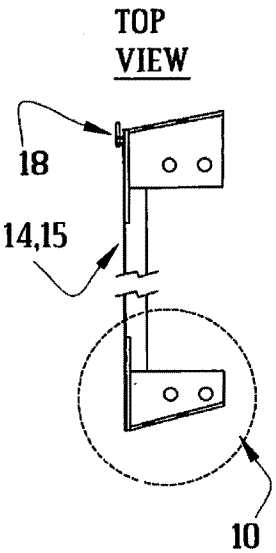
FIG. 6 is the top views of the bolting connection showing a vertical edge lip, the lateral pitch of the bolting members.
Figure 7:
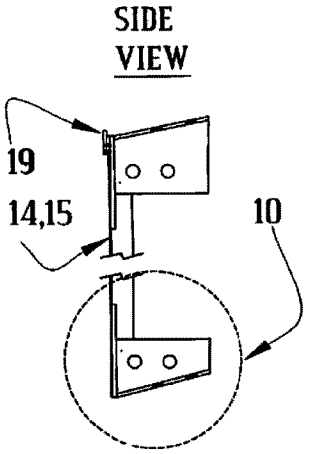
FIG. 7 is side views of the bolting connection showing horizontal edge lip, bolting patterns and angles which stem from the foundation to the wall cell connections.
Figure 5:
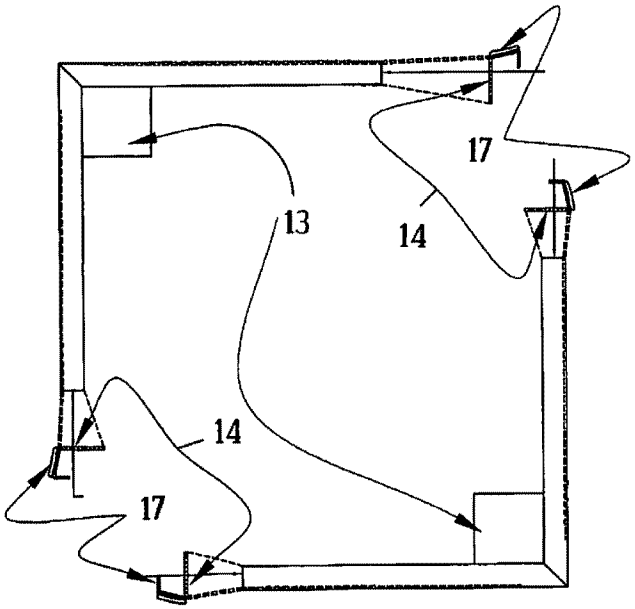
FIG. 5 is a view of the angled edges that facilitate the removal of wall cells on an assembled wall.
Figure 8:
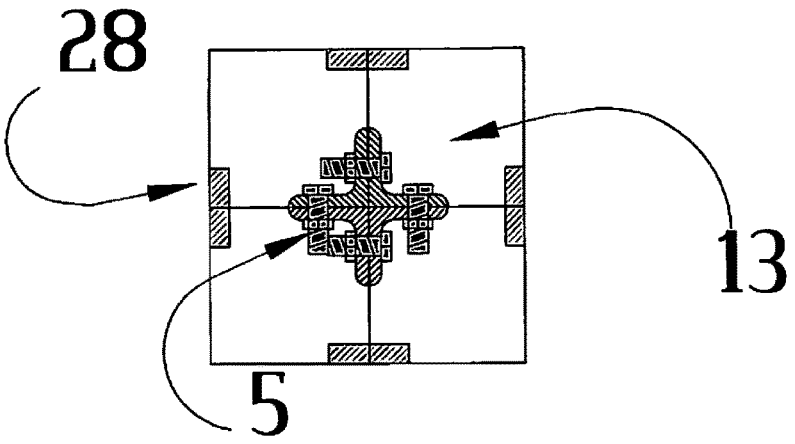
FIG. 8 is a view that shows the directional pattern of the fasteners of the static area of 4 wall cells in an assembled form.
Figure 9:
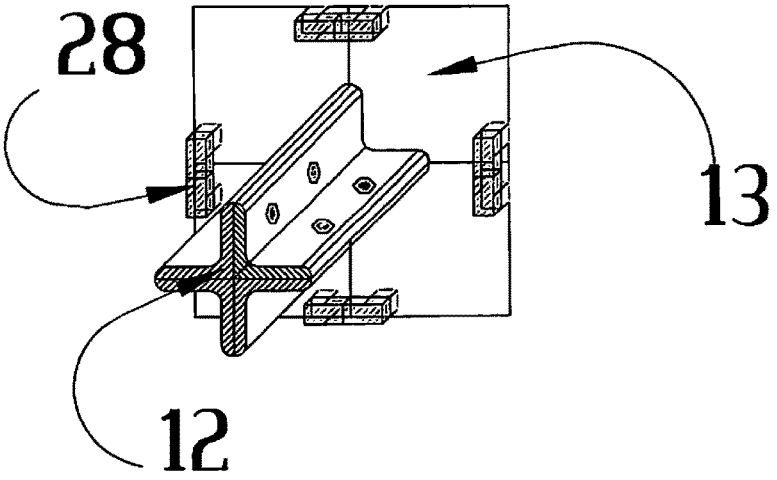
FIG. 9 is a view of the static area of four wall cells in an assembled form. These connections are a plurality among the assembled wall that will add a calculated resistance of both lateral movement and influx from wind and other natural events.
Figure 10:
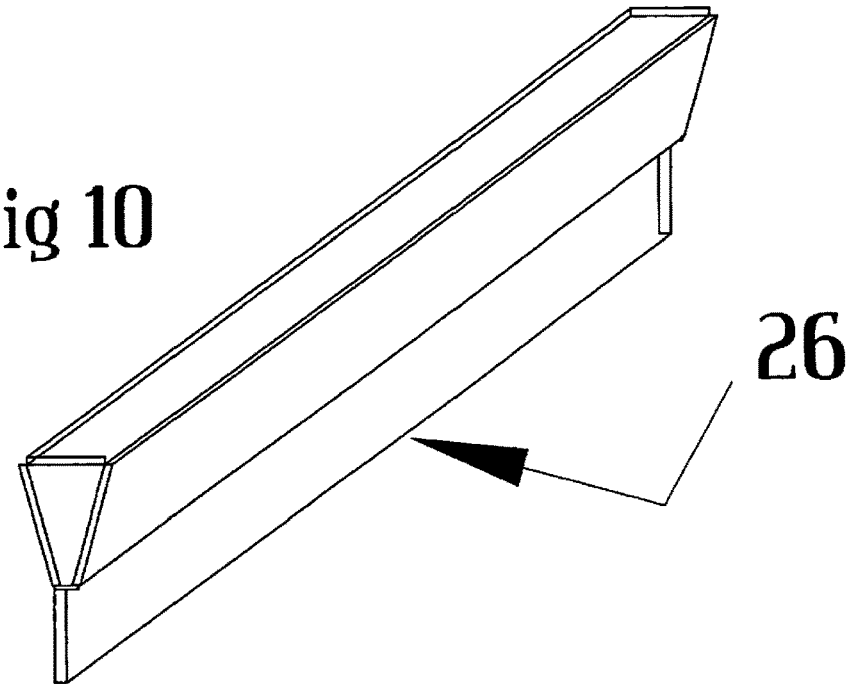
FIG. 10 is a view of the roof ridge attachment providing the same bolting pattern for pitched roof cells.
Figure 11:
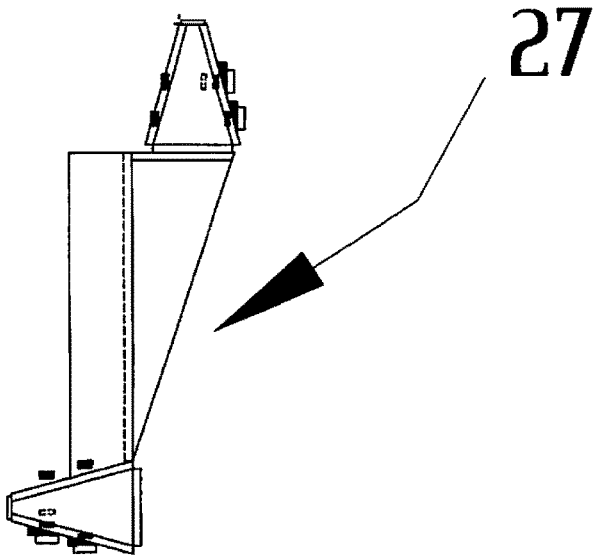
FIG. 11 is a view of the roof attachment connections that are angled to change the plane of the wall cell to provide a pitched roof.
Figure 12:
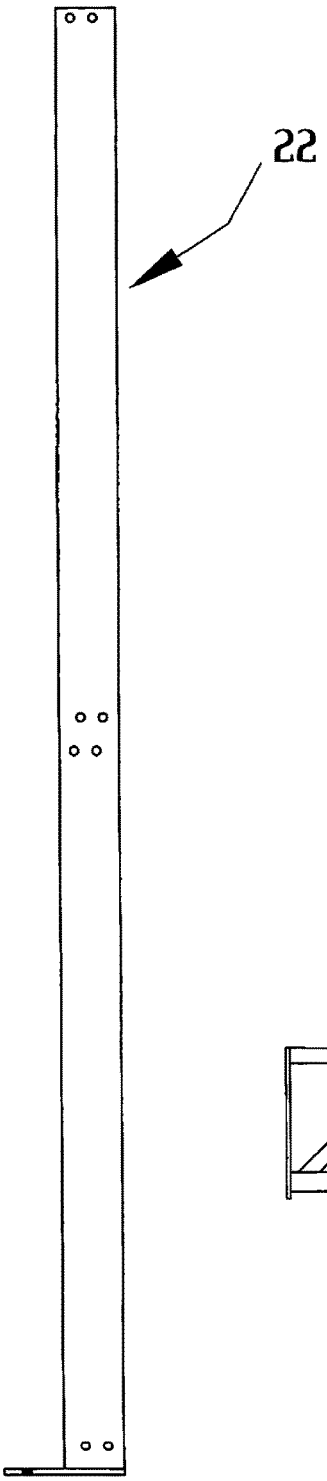
FIG. 12 shows the peripheral structural elements, a corner post and a floor base. These elements are necessary to set the foundation of the parameters and initiate the wall cell assembly.
Figure 13:
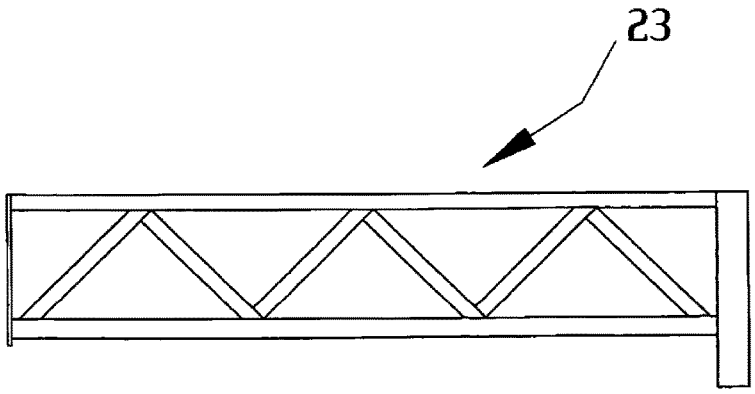
FIG. 13 is an exemplary base structure for connecting foundation with the wall cells.
Figure 14:
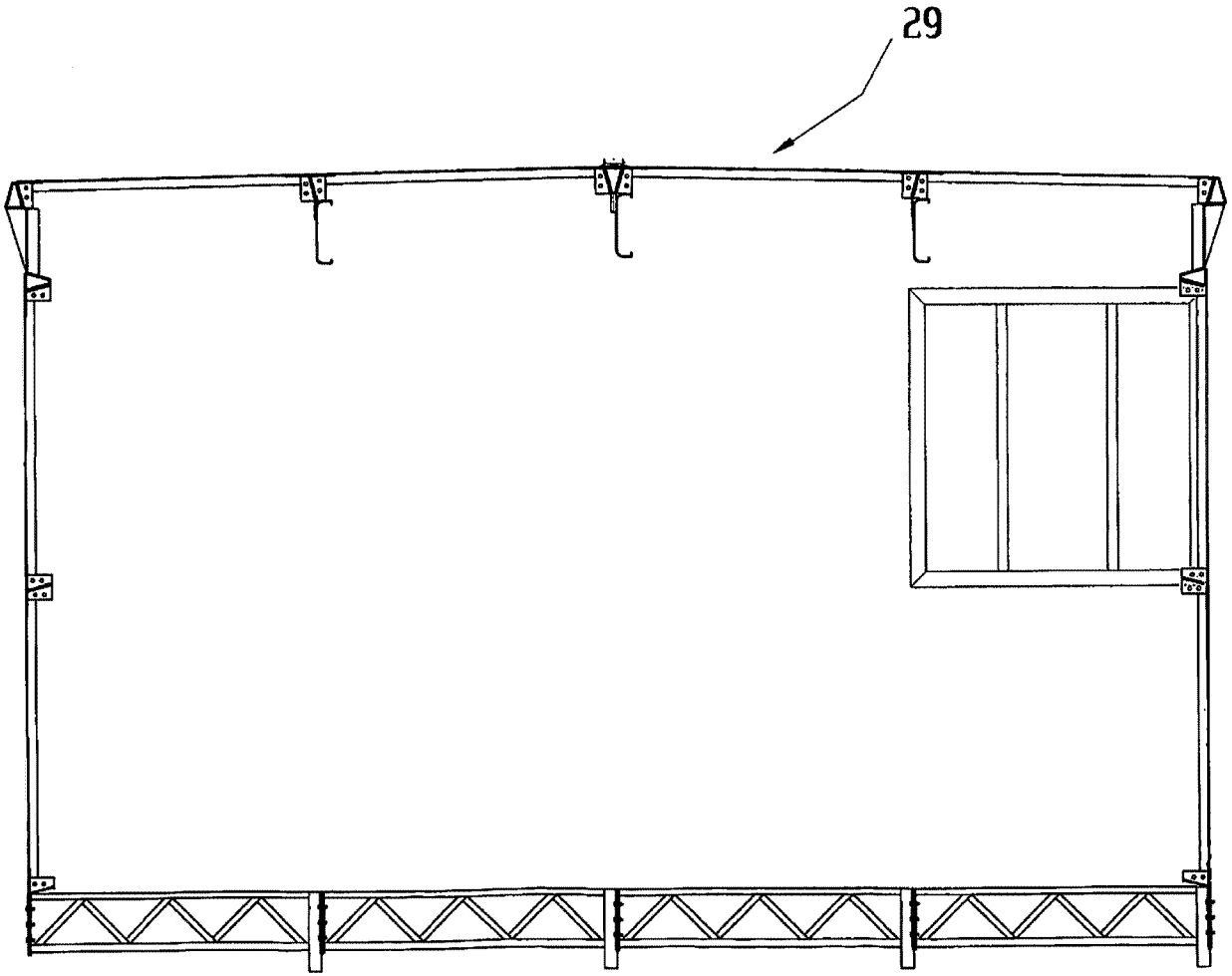
FIG. 14 shows an open-ended view of an assembled housing with visible structural elements.
Figure 15:
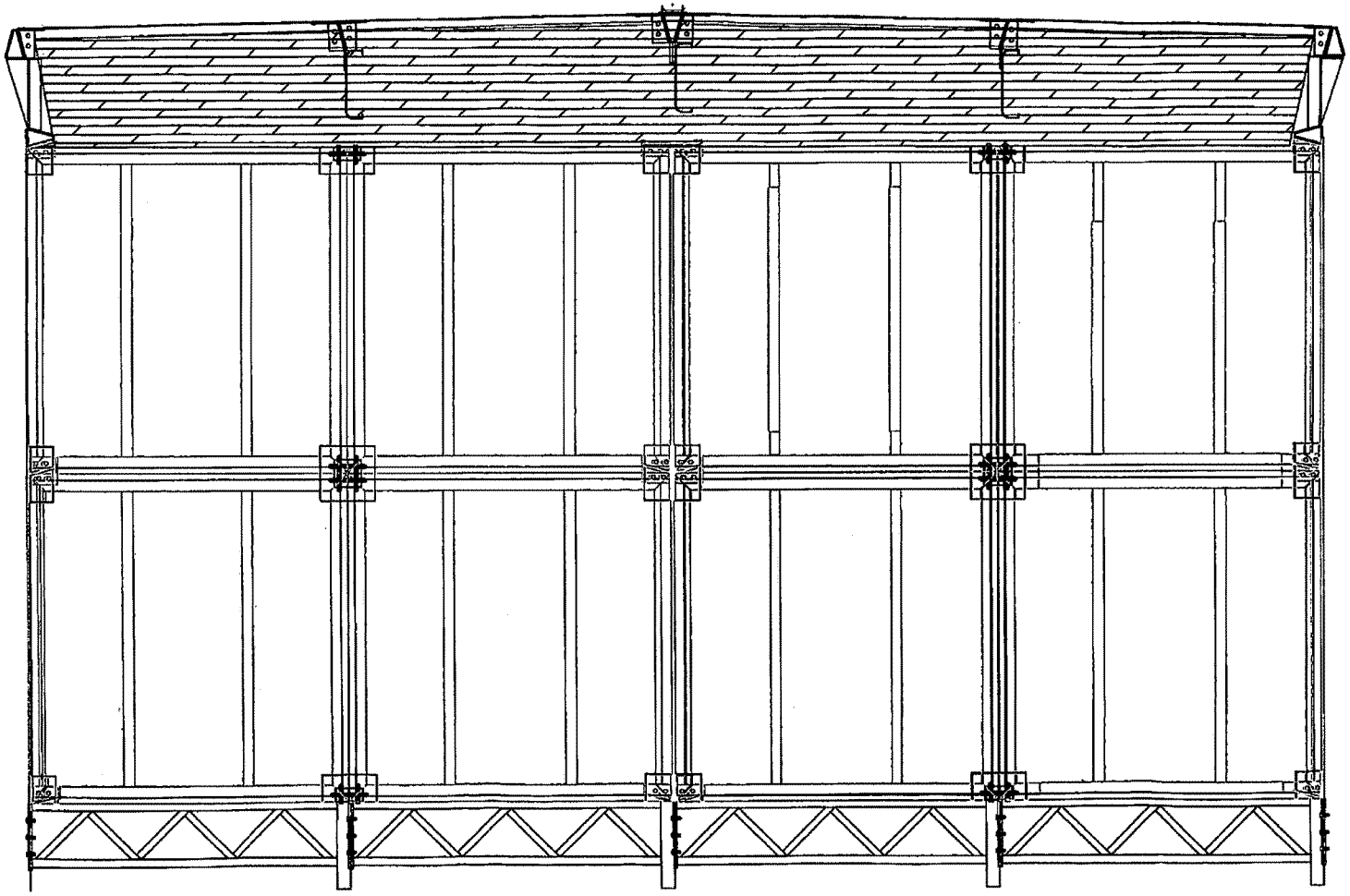
FIG. 15 is a view of an assembled housing with fillers and roofing. At this point the exterior of the housing would be covered with a normally available exterior covering such as siding, shingles, bricks or stucco.
Figure 16:
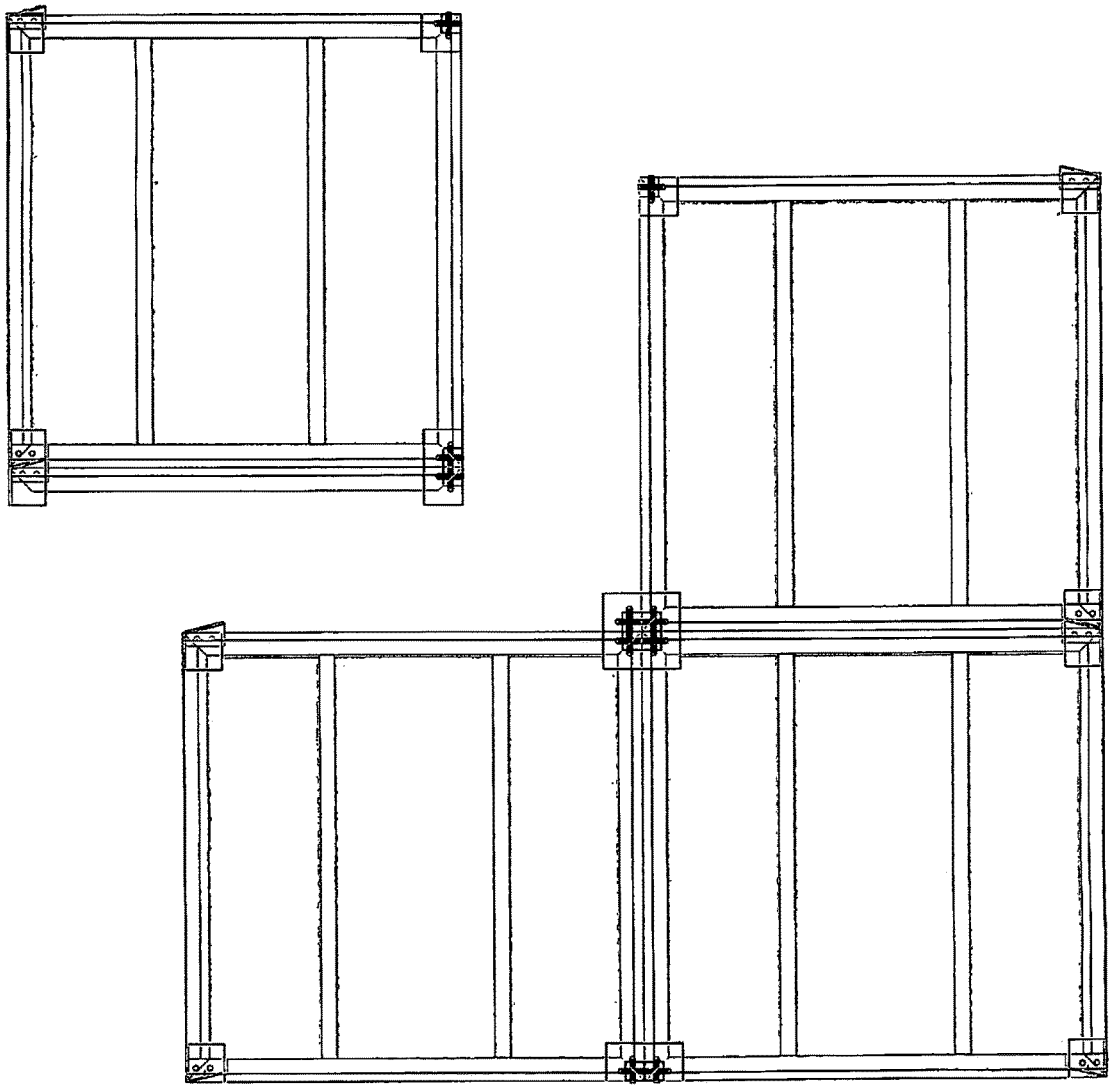
FIG. 16 is an example to show the capability of a wall cell removal from an assembled wall.

Filler embodiment can contain functional or artistic attribute like door in [FIG. 4], window [FIG. 3] or other attributes can be designed using computers or private designers and made in special production runs in manufacturing or added in at an intermediate or post manufacturing process.

Wall cells that are a plurality embodiment abutting vertically and horizontally by means of cross-bolting that triggers the straightening of the cambered edges yielding compressed tightness and creating stress on the material of the abutting edges to increase tensile strength as the housing is erected.

The frame is a multiple purpose device acting as a design control, a bonding mechanism and a structural element. The connection points of the wall cells will ensure that the wall cells line up and are suitably attached as the housing is being assembled. The compression of the edges requires no extra steps in solidly locking together the walls. These edges can be altered as to the requirements of the housing. The formed edges can be thicker and shorter with a larger camber if the bond is to be very strong, or they could be thin, shorter and straighter for a light-purpose housing. The structural element combines a static location among a group of wall cells to create a moment connection. Extra steps in engineering will determine optimal sizes of and placement of the static structural elements that will be utilized in different situations.

The bolting member sticks out like a foot and makes intersections of the wall cells the area that creates the amount of influx resistance to be instilled in the wall cell embodiment. The bolt members, when torqued down, are the solid connection for the wall cells which provides the ability to adjoin the bolting assembly (10), straighten the cambered edges (15) and hold static the Stiffener Plate (13). The stiffener plate is welded onto the bolting assembly to start the angle the wall will extend from the very corner of the frame. Edges are attached solidly using welds, bonding or fasteners to the bolting angle and press down to fit slip-pins connections intermittently on the stiffener plate (13). The edges are the periphery of the filler and could be bowed outwardly so that the plurality of the frames will make a circle or dome. The filler is the ideally made of recycled material that can be securely attached to the frame edges, but since it is an secondary accompaniment with the intended use of the present patent, it could conceivably be other previously known methods of construction such as plywood with studs but could be other building materials ranging from canvas to concrete.

Prior to constructing the housing, the invention will be picked from an inventory and packaged onto crates with detailed assembly instructions and loaded onto a van, truck, trailer or other transport vessel. The desired foundation will have already been laid out where the housing will stand. The foundation template (25) will be laid out and secured. The base attachments (23) are then attached to the foundation using anchors (i.e. wedge anchors, epoxy bolts). They are secured to the foundation in alignment and have attachment points that will meet with the bolt members of the wall cell frame. At the time of assembly, the frames will be brought in sequential order as to the assembly instructions. The typical way to assemble the frames is laying the frames around the base, bolting in lower wall cells then continuing the housing periphery and moving up the wall as it rises. Corner post (22) can be anchored to the foundation and attached to the adjacent wall cells for structural purposes, but assembling walls on the ground then standing it up could keep more work close to the ground.

Roof structure (19) and parameter (29) covers are bolted on above the top row of wall cells.

The roof cells are then bolted to the roof structure (19) in a back and forth pattern from one end of the housing to the other. The assembly of the invention is complete by placing the cover (29) over the opening under the roof ridge and is in full use of the owner. The owner can continue to utilize the invention by removing or adding wall cells to change the configuration of the housing walls for multiple possible reasons.

Current forms of housing require great efforts and expense to change the size location or attributes. In today's society, families are often requiring to add or reduce the amount of living space of their residences due to the changing demographics of modern families. The need for storage in construction may change from job to job by needing a few small hand tools on one job and then several pieces of equipment on the next job. Also people who are camping may want a bigger hut, or they may need to pull a smaller trailer from outing to outing.

The invention area wall cells that are a plurality in an embodiment abutting vertically and horizontally by means of cross-bolting that triggers that straightening of the cambered edges yielding compressed tightness and creating stress on the material of the abutting edges to increase tensile strength.

Other inventions of panels are full floor height, composite in nature, lacking structural elements, made of a tongue and groove alignment and have either inadequate bolting or vast number of connections.

I claim:

1. A modular, interconnectable wall cell, comprising:

a plurality of frame members comprising a top frame member, a bottom frame member, a first side frame member, and a second side frame member;

each of the plurality of frame members connected together to define a periphery of the modular, interconnectable wall cell;

the periphery of the modular, interconnectable wall cell having a plurality of corners;

each of the plurality of frame members defining a cambered edge that extends outwardly from an outer surface of each of the plurality of frame members;

a plurality of stiffener plates, each of the plurality of stiffener plates having an inner surface and being attached to two adjacent frame members of the plurality of frame members at a corresponding one of said plurality of corners;

each of the plurality of stiffener plates comprising an angle member attached to the inner surface, the angle member having a length extending at an angle of 70 degrees to 110 degrees with respect to the inner surface and comprising a first attachment portion and a second attachment portion, the first attachment portion integrally connected to the second attachment portion and extending perpendicular thereto;

each of the first and second attachment portions having a width and a thickness, the thickness being ⅛ inches to ⅜ inches, and further comprising a plurality of cross-bolt holes extending perpendicular to the width and parallel to the thickness for receiving bolts therethrough;

at least one panel filler defining a wall surface attached to an inner surface of each of the plurality of frame members;

wherein each of the plurality of stiffener plates lies in a plane parallel to the wall surface;

wherein, when the modular, interconnectable wall cell is connected to an adjacent modular, interconnectable wall cell, at least one of the angle members abuts an adjacent angle member of the adjacent modular, interconnectable wall cell, bolts are fastened through the cross-bolt holes and at least one of the cambered edges of the plurality of frame members bows inwardly toward the wall surface.

* * * * *